US010783779B1

(12) United States Patent
Meyer et al.

(10) Patent No.: US 10,783,779 B1
(45) Date of Patent: Sep. 22, 2020

(54) INTELLIGENT ROAD MARKERS

(71) Applicant: TOYOTA MOTOR NORTH AMERICA, INC., Plano, TX (US)

(72) Inventors: Scott R. Meyer, Allen, TX (US); Eduard J. Vandersmitte, McKinney, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 0 days.

(21) Appl. No.: 16/529,581

(22) Filed: Aug. 1, 2019

(51) Int. Cl.

| | |
|---|---|
| ***G08G 1/00*** | (2006.01) |
| ***G08G 1/095*** | (2006.01) |
| ***E01F 9/559*** | (2016.01) |
| ***G08G 1/0967*** | (2006.01) |

(52) U.S. Cl.
CPC ..... *G08G 1/095* (2013.01); *E01F 9/559* (2016.02); *G08G 1/096783* (2013.01)

(58) Field of Classification Search
None
See application file for complete search history.

(56) References Cited

U.S. PATENT DOCUMENTS

| | | | | |
|---|---|---|---|---|
| 9,293,044 | B2 | 3/2016 | Chen | |
| 9,396,656 | B2 | 7/2016 | Cazanas | |
| 9,453,309 | B2 | 9/2016 | Moran | |
| 2014/0126574 | A1* | 5/2014 | Trahan | H04L 12/1845 370/390 |
| 2018/0310242 | A1 | 10/2018 | Konishi | |
| 2018/0374342 | A1* | 12/2018 | Farajpour | H04W 84/18 |

* cited by examiner

*Primary Examiner* — Adolf Dsouza
(74) *Attorney, Agent, or Firm* — Sheppard, Mullin, Richter & Hampton LLP; Hector A. Agdeppa; Daniel N. Yannuzzi

(57) ABSTRACT

Systems and methods are provided for intelligent road markers. An intelligent road marker comprises a transceiver; a hardware processor; and a non-transitory machine-readable storage medium encoded with instructions executable by the hardware processor to perform a method comprising: receiving a message via the transceiver, the message describing a condition related to a road where the intelligent road marker is deployed; determining a direction in which the message is to be propagated; selecting another one of a plurality of the intelligent road markers according to the determined direction, and a stored deployment pattern of the intelligent road markers; and causing the transceiver to transmit the message to the selected intelligent road marker.

17 Claims, 6 Drawing Sheets

INTELLIGENT ROAD MARKERS

TECHNICAL FIELD

The present disclosure relates generally to road infrastructure, and in particular, some implementations may relate to communications technology for such road infrastructure.

DESCRIPTION OF RELATED ART

With recent advancements, communications technology is increasingly being deployed in road infrastructure. For example, electronic road signs are currently used to apprise drivers of traffic conditions, travel time to certain destinations, and detours.

BRIEF SUMMARY OF THE DISCLOSURE

According to various embodiments of the disclosed technology, intelligent road markers are described, along with methods and computer-readable media therefor.

In general, one aspect disclosed features an intelligent road marker that includes a transceiver; a hardware processor; and a non-transitory machine-readable storage medium encoded with instructions executable by the hardware processor to perform a method comprising: receiving a message via the transceiver, wherein the message describes a condition related to a road where the intelligent road marker is deployed; determining a direction in which the message is to be propagated; selecting another one of a plurality of the intelligent road markers according to the determined direction, and a stored deployment pattern of the intelligent road markers; and causing the transceiver to transmit the message to the selected intelligent road marker.

Embodiments of the method may include one or more of the following features. In some embodiments, the message includes a count, and the method further comprises: decrementing the count; and causing the transceiver to transmit the message only when the decremented count is not zero. Some embodiments comprise a luminous element; wherein the method further comprises illuminating the luminous element based on the message. In some embodiments, the method further comprises:

illuminating the luminous element with a color and a timing according to the message. In some embodiments, the method further comprises: causing the transceiver to transmit the message to a vehicle or a roadside communications station. In some embodiments, receiving the message comprises: receiving the message from a vehicle or a roadside communications station. In some embodiments, each of the intelligent road markers includes a luminous element; and the intelligent road markers cause the luminous elements to form a determined pattern on the road in accordance with the message.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

The figures are not exhaustive and do not limit the present disclosure to the precise form disclosed.

DETAILED DESCRIPTION

Embodiments of the disclosed technology provide intelligent road markers. These intelligent road markers include communications technology for relaying messages along roads, with vehicles, and with roadside communications stations. In some embodiments, the intelligent road markers also include luminous elements that can be used to provide warnings to motorists, to guide motorists around road obstacles, and the like. For example, a vehicle or roadside communications stations may detect an obstacle in the road, such as a stopped vehicle. The vehicle or road infrastructure may generate a warning message, and may pass this message to one or more of the intelligent road markers. The intelligent road markers may relay this message along the road, and then pass the message to other vehicles, and to other roadside communications stations. In some embodiments, the intelligent road markers may employ their luminous elements to create lighting patterns to guide motorists around the stopped vehicle.

In some embodiments, the intelligent road markers are deployed in the road itself, for example as reflector units. In other embodiments, the intelligent road markers may be deployed alongside the road. In still other embodiments, a combination of these deployments may be employed.

Figure 1:
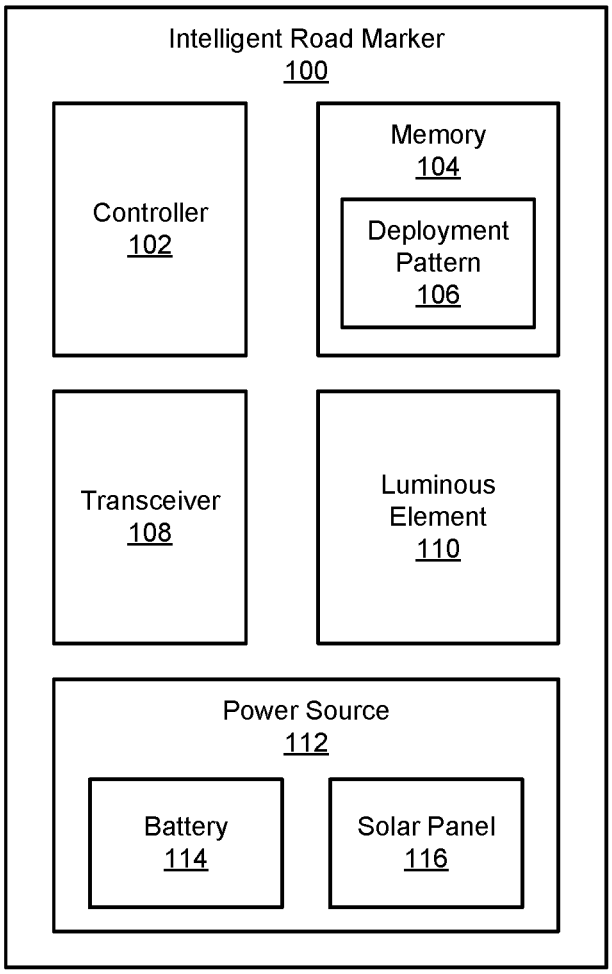
FIG. 1 is a block diagram of an example intelligent road marker according to embodiments of the disclosed technology.

FIG. 1 is a block diagram of an example intelligent road marker 100 according to embodiments of the disclosed technology. Referring to FIG. 1, the example intelligent road marker 100 may include a controller 102. The controller 102 may be implemented as a microcontroller, a microprocessor, or as other computing components such as those described below. The example intelligent road marker 100 may include a memory 104. The memory 104 may store instructions for execution by the controller 102.

The memory 104 may also store a deployment pattern 106 of a number of road markers including the example intelligent road marker 100. The deployment pattern 106 of the road markers 100 may include direction and distance to each neighboring marker 100, network addresses of neighboring markers 100, network addresses of nearby roadside communications stations, and the like. In some embodiments, the deployment pattern 106 may be generated and stored in the memory 104 during installation of the road marker 100. In other embodiments, the road marker 100 may generate the deployment pattern 106 after installation, through auto-discovery processes such as those commonly used in wireless networks.

The example intelligent road marker 100 may also include a transceiver 108. In the described embodiments, the transceiver 108 is a wireless transceiver, for example such as a Bluetooth transceiver, a Wi-Fi transceiver, or a custom RF transceiver. But in other embodiments, the transceiver 108 may be a wired transceiver for use in roads having communication cables embedded in the road.

The example intelligent road marker 100 may also include one or more luminous elements 110. The luminous element 110 may be implemented as any luminous device. For example, the luminous elements 110 may be implemented as light-emitting diodes (LED). In some embodiments, the luminous elements 110 may be controlled to generate lights of different colors, intensities, and timing patterns. In some embodiments, the luminous elements may be controlled to project light in specified directions.

The example intelligent road marker 100 may include a power source 112. The power source 112 may include one or more batteries 114, which may be implemented as rechargeable batteries. The power source 112 may include one or more solar panels 116. In embodiments that include rechargeable batteries, the solar panels 116 may be arranged to recharge those batteries.

Figure 2:
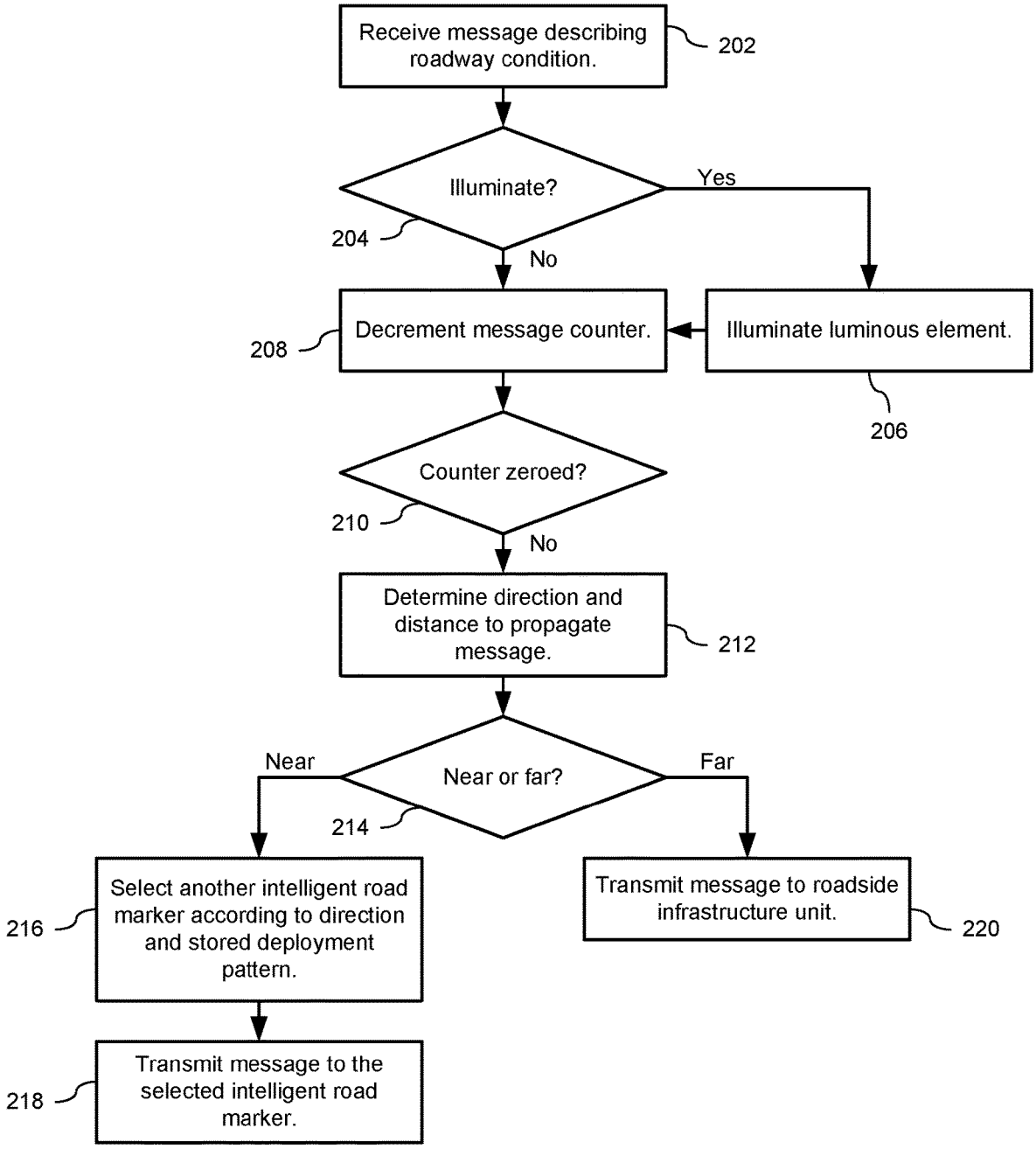
FIG. 2 illustrates a process for an intelligent road marker according to embodiments of the disclosed technology.

FIG. 2 illustrates a process for an intelligent road marker 100 according to embodiments of the disclosed technology. Referring to FIG. 2, the intelligent road marker 100 may receive a message describing a road condition, at 202. Example road conditions may include obstacles in the road such as stopped vehicles and vehicle crashes, standing water, emergency road closures, and the like. The intelligent road marker 100 may receive such messages from vehicles on the road, roadside communications stations, or other intelligent road markers 100.

The message may indicate whether the intelligent road marker 100 should illuminate, at 204. If so, the marker 100 may cause its luminous element 110 to illuminate. The message may specify the illumination color, pattern, direction, timing, and the like. In such embodiments, the marker 100 causes its luminous element to illuminate accordingly.

In some embodiments, distribution of the message may be limited. For example, a warning message concerning a road obstacle may be limited in distribution according to a determined count value. For example, the message may include a counter field containing the count value. On receiving the message, the intelligent road marker 100 decrements the value of the counter, at 208. When the decremented value is non-zero, at 210, the marker 100 transmits the message, with the decremented counter value, as described below. But when the decremented value is zero, at 206, the marker 100 does not transmit the message. In this manner, the distribution of the message may be limited. This technique may be employed, for example, to generate a road illumination pattern that is limited in size.

The intelligent road marker 100 may determine a direction and distance for propagating the message, at 212. The determination of direction may be implemented in a number of ways. For example, the intelligent road marker 100 may select a direction based on the deployment pattern 106. Based on the deployment pattern 106, the intelligent road marker 100 may be aware of the direction to each neighboring intelligent road marker 100. In some embodiments, the intelligent road marker 100 may simply select a neighboring marker 100 in the opposite direction from which the message was received. In some embodiments, the intelligent road marker 100 may simply select every neighboring marker 100 except the marker 100 that transmitted the message. In some embodiments, the direction may be specified by the message itself.

The determination of the distance over which to propagate the message may also be made in a number of ways. In some embodiments, the distance may be determined based on the count in the message, for example in conjunction with knowledge of the distance or average distance between the intelligent road markers 100, which may be specified by the deployment pattern 106. In other embodiments, the distance may be specified in the message itself.

In some embodiments, the distance may be used to determine the manner of propagation of the message. For example, the intelligent road marker 100 may determine whether the distance is near or far, at 214. For example, the marker 100 may compare the distance to a distance threshold to make this determination. Over great distances, other road infrastructure may relay the message more rapidly than the markers 100. When the marker 100 determines that the distance is far, the marker 100 may transmit the message to a roadside communications station rather than to a neighboring marker 100, at 220.

But if the determined distance is near, the intelligent road marker 100 may select one or more other intelligent road markers 100, at 216, for example according to the determined direction, and the stored deployment pattern 106, as described above. The intelligent road marker 100 may then transmit the message to the one or more selected markers 100, at 218.

Figure 3:
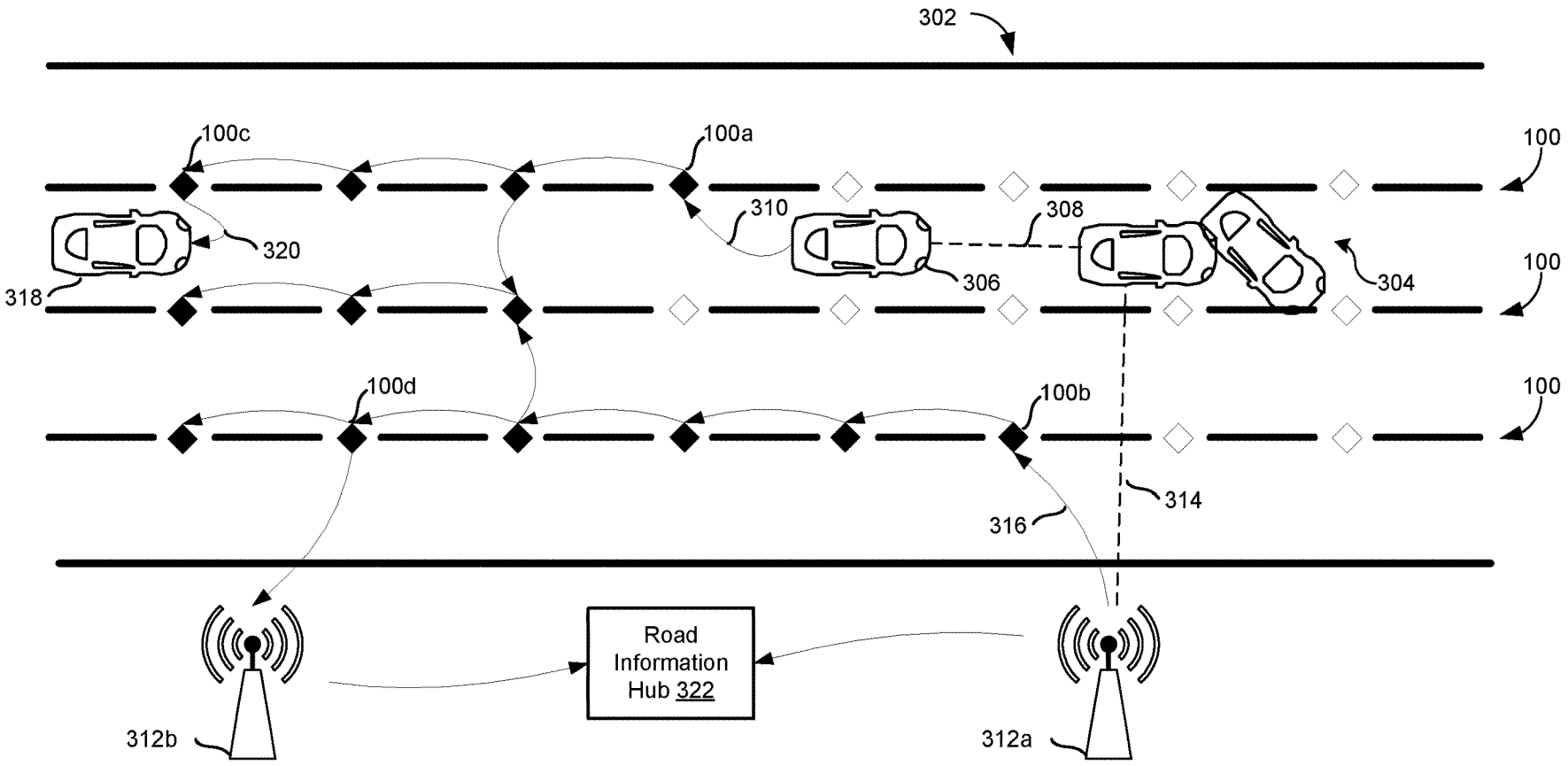
FIG. 3 illustrates an example operation of the intelligent road markers 100 according to embodiments of the disclosed technology.

FIG. 3 illustrates an example operation of the intelligent road markers 100 according to embodiments of the disclosed technology. Referring to FIG. 3, a four-lane one-way road 302 includes a plurality of intelligent road markers 100, deployed at regular intervals between the lanes. In FIG. 3, an obstacle is present in the road 302, in the form of a two-car crash, as shown at 304.

Another car 306 has automatically detected the crash, using automated sensor technology, as shown generally at 308. Such technology may take many forms, and may include sensors such as radar, lidar, forward-looking infrared, and the like. Responsive to detecting the crash, the car 306 may generate a corresponding message, and may transmit the message to an intelligent road marker 100*a*, as shown at 310. This transmission may employ vehicle-to-vehicle communications or the like. Responsive to receiving the message, the marker 100*a* may illuminate. The marker 100*a* may relay the message to other markers 100 in the direction of oncoming traffic. These markers 100 may also illuminate. In FIG. 3, illuminated markers 100 are shown as black diamonds, while markers 100 that are not illuminated are shown as white diamonds.

In some embodiments, the crash may be automatically detected by a roadside communications station 312*a*, as shown at 314. This detection may involve sensors similar to those described above for the car 306. Responsive to detecting the crash, the roadside communications station 312*a* may generate a corresponding message, and may transmit the message to an intelligent road marker 100*b*, as shown at 316. Responsive to receiving the message, the marker 100*b* may illuminate. The marker 100*b* may relay the message to other markers 100 in the direction of oncoming traffic. These markers 100 may also illuminate.

In some embodiments, the intelligent road markers 100 may relay the message to other vehicles. For example, in FIG. 3, a marker 100*c* relays the message to a car 318, as shown at 320. Such relays may employ vehicle-to-vehicle communications or the like. Responsive to receiving the message, the car 318 may take one or more actions. For example, the car 318 may display the message to occupants of the car 318, automatically apply the brakes of the car 318, and the like. The car 318 may also relay the message to nearby cars, for example using vehicle-to-vehicle communications.

In some embodiments, the intelligent road markers 100 may relay the message to other roadside communication infrastructure. For example, in FIG. 3, a marker 100*d* relays the message to roadside communication infrastructure 312*b*. The roadside communications stations 312 may communicate the message to a road infrastructure hub 322. The hub 322 may alert first responders, providing the location of the car crash.

Figure 4:
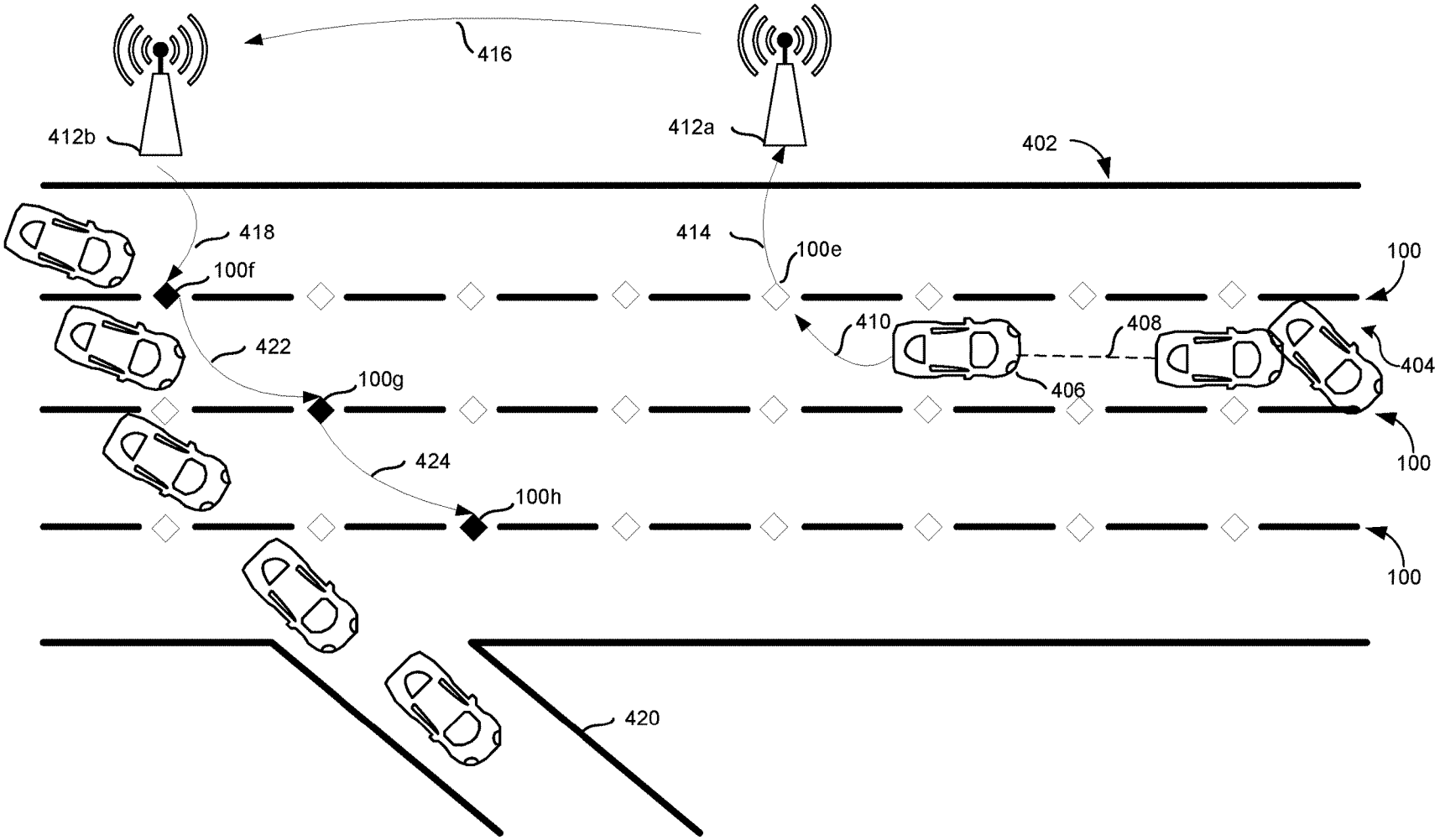
FIG. 4 illustrates another example operation of the intelligent road markers according to embodiments of the disclosed technology.

FIG. 4 illustrates another example operation of the intelligent road markers 100 according to embodiments of the disclosed technology. Referring to FIG. 4, a four-lane one-way road 402 includes a plurality of intelligent road markers 100, deployed at regular intervals between the lanes. In FIG. 4, an obstacle is present in the road 402, in the form of a two-car crash, as shown at 404.

Another car 406 has automatically detected the crash, using automated sensor technology, as shown generally at 408. Responsive to detecting the crash, the car 406 may generate a corresponding message, and may transmit the message to an intelligent road marker 100*e*, as shown at 410. This transmission may employ vehicle-to-vehicle communications or the like.

In the example of FIG. 4, the intelligent road marker 100*e* determines the direction and distance in which the message should be propagated, and based on the distance, determines that the message should be propagated using roadside communications stations 412. Accordingly, the marker 100*e* relays the message to roadside communications station 412*a*, as shown at 414. Based on the distance in the message, the roadside communications station 412*a* relays the message to roadside communications station 412*b*, as shown at 416. The roadside communications station 412*b*, in turn, relays the message to the intelligent road marker 100*f*, as shown at 418.

In the example of FIG. 4, the message indicates that the intelligent road markers 100 should form an illumination pattern that guides vehicles off the road at an exit 420. This pattern may be part of the deployment pattern 106 stored in the markers 100. Accordingly, the marker 100*f* illuminates, and the message is relayed at 422 and 424 to road markers 100*g* and 100*h*, which also illuminate to form the pattern. Other patterns may be part of the deployment pattern 106 stored in the markers 100.

In some embodiments, the intelligent road markers 100 may be employed to warn drivers of the presence or approach of an emergency vehicle. In such embodiments, the emergency vehicle may transmit one or more messages to the markers 100. The messages may indicate that the markers 100 should be illuminated with a specific color and timing pattern. In the case of the emergency vehicle such as an ambulance or fire truck, message may indicate that the markers should blink red. The messages may also indicate a distance of the roadway that should be illuminated in front of the emergency vehicle to warn drivers that the emergency vehicle is approaching, for example such as a quarter-mile. The messages may also indicate a distance of the roadway that should be illuminated behind the emergency vehicles to discourage drivers from following too closely, for example such as an eighth of a mile. The messages may also cause the markers 100 to generate illumination patterns that guide other vehicles away from the path of the emergency vehicle. For example, the patterns make guide other vehicles to the shoulders of the roadway in advance of the approach of the emergency vehicle.

In this embodiment, the intelligent road markers 100 may communicate information concerning the emergency vehicle to other vehicles, for example by using vehicle-to-infrastructure and infrastructure-to-vehicle communications. The information may indicate the location and speed of the emergency vehicle. Using this information, the vehicles receiving the information may generate a map display that indicates the position and speed of the approaching emergency vehicle, and estimated time of arrival of the emergency vehicle, and the like. The vehicles receiving the information may also generate audible alerts for the occupants, and the like.

In some embodiments, the messages may prioritize message flow in one or more directions over message flow in other directions. For example, in the case of an emergency vehicle, the messages may prioritize message flow from the emergency vehicle forward to warn vehicles ahead of the emergency vehicle of its approach. In the case of a crash or stop vehicle, the messages may prioritize message flow in the directions of oncoming traffic over message flow in the directions of traffic moving away from the accident.

In some embodiments, the intelligent road markers 100 may be used to convey messages indicating the presence of an unsafe driver. The unsafe driving may be detected automatically by the roadway markers 100, by the roadside communications stations, and the like. In other embodiments, the unsafe driving may be reported by other drivers. In either case, messages concerning the unsafe driving may be relayed to the intelligent road markers 100. In these embodiments, message flow in the vicinity of the unsafe driver may be prioritized over message flow to other areas of the road.

In some embodiments, the intelligent road markers 100 may be used to convey information to drivers that is specific to individual lanes of the road. For example, the markers 100 may be used to apply different speed limits to different lanes of a multi-lane road. For example, an express lane with a high speed limit may be indicated by markers 100 with a slow green flash, while a merge lane with a low speed limit may be indicated by markers 100 with the rapid red flash. The meaning of these colors and flash rates may be conveyed by the markers 100 to the vehicles, for example using infrastructure-to-vehicle messages. Responsive to receiving these messages, the vehicles may display representations of this information to the occupants. For example, vehicle display may show a map of the road with the respective speed limits displayed for each lane.

Figure 5:
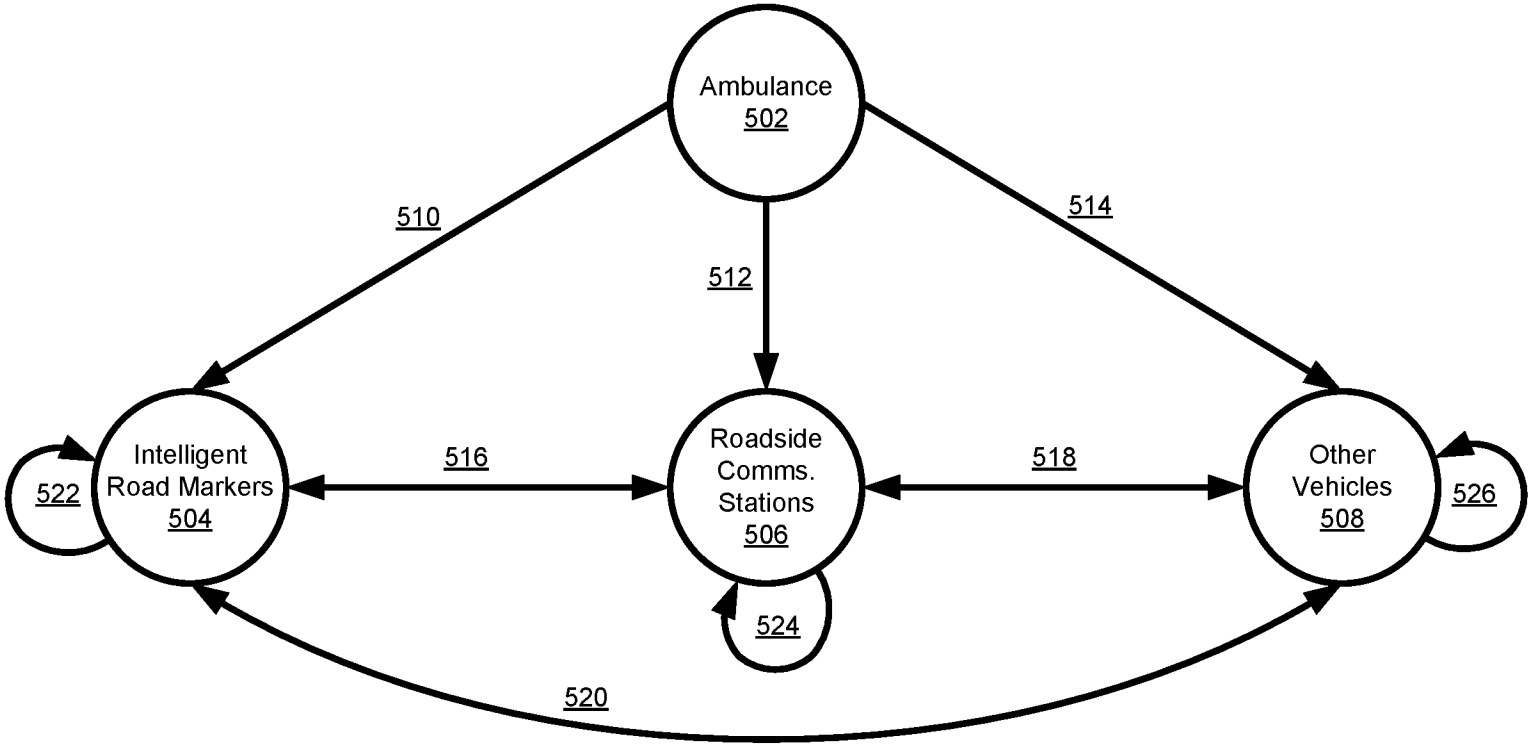
FIG. 5 illustrates an example message flow according to embodiments of the disclosed technology.

FIG. 5 illustrates an example message flow according to embodiments of the disclosed technology. In the example of FIG. 5, the message flow begins with an ambulance 502 that receives an emergency call. Responsive to receiving the emergency call, an occupant of the ambulance activates its emergency systems. The emergency systems begin to transmit messages. For example, the ambulance 502 may transmit messages to nearby intelligent road markers 504, as shown at 510. The ambulance 502 may also transmit messages to roadside communications stations 506, shown at 512. The ambulance 502 may also transmit messages to other vehicles 508, as shown at 514.

Responsive to receiving these messages, the intelligent road markers 504 begin relaying messages. The markers 504 may relay the messages to other markers 504, as shown at 522. The markers 504 may relaying the messages to roadside medication stations 506, as shown at 516. The markers may relay the messages to other vehicles 508, as shown at 520.

Responsive to receiving these messages, the roadside communications stations 506 may relay the messages to intelligent road markers 504, as shown at 516. The stations 506 may relay the messages to other stations 506, as shown at 524. The stations 506 may relay the messages to other vehicles 508, as shown at 518.

Responsive to receiving these messages, the vehicles 508 may relay the messages to the intelligent road markers 504, as shown at 520. The vehicles 508 may relay the messages to roadside communications stations 506, shown at 518. The vehicles 508 may relay the messages to other vehicles 508, as shown at 526.

As illustrated in FIG. 5, the intelligent road markers 504, roadside communications stations 506, and vehicles 508 may form an intelligent network for the propagation of these messages. This propagation may include any of the features described above. For example, the messages may cause the intelligent road markers 504 to illuminate to warn of the approach of the ambulance 502, and to guide the vehicles 508 out of the path of the ambulance 502. The direction of propagation of the messages may be controlled as well. For example, the messages may be controlled to propagate only along roads the ambulance 502 will follow to its destination, and adjoining roads. The roadside communications stations 506 may be employed to leapfrog the messages ahead to clear busy intersections. In this manner, the intelligent road markers 504 disclosed herein may ensure the safety of everyone involved.

Figure 6:
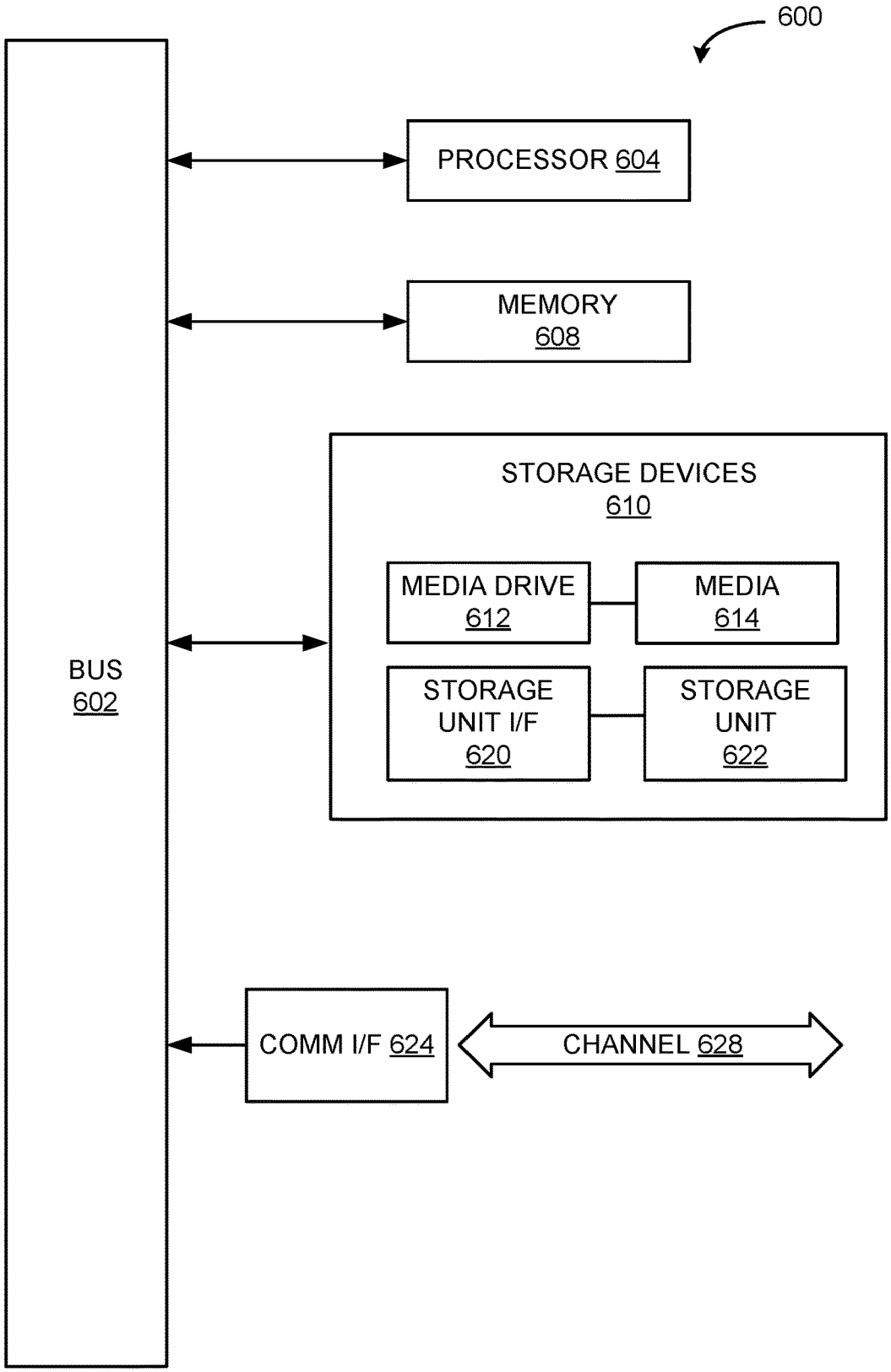
FIG. 6 is an example computing component that may be used to implement various features of embodiments described in the present disclosure.

As used herein, the terms circuit and component might describe a given unit of functionality that can be performed in accordance with one or more embodiments of the present application. As used herein, a component might be implemented utilizing any form of hardware, software, or a combination thereof. For example, one or more processors, controllers, ASICs, PLAs, PALs, CPLDs, FPGAs, logical components, software routines or other mechanisms might be implemented to make up a component. Various components described herein may be implemented as discrete components or described functions and features can be shared in part or in total among one or more components. In other words, as would be apparent to one of ordinary skill in the art after reading this description, the various features and functionality described herein may be implemented in any given application. They can be implemented in one or more separate or shared components in various combinations and permutations. Although various features or functional elements may be individually described or claimed as separate components, it should be understood that these features/functionality can be shared among one or more common software and hardware elements. Such a description shall not require or imply that separate hardware or software components are used to implement such features or functionality.

Where components are implemented in whole or in part using software, these software elements can be implemented to operate with a computing or processing component capable of carrying out the functionality described with respect thereto. One such example computing component is shown in FIG. 6. Various embodiments are described in terms of this example-computing component 600. After reading this description, it will become apparent to a person skilled in the relevant art how to implement the application using other computing components or architectures.

Referring now to FIG. 6, computing component 600 may represent, for example, computing or processing capabilities found within a self-adjusting display, desktop, laptop, notebook, and tablet computers. They may be found in hand-held computing devices (tablets, PDA's, smart phones, cell phones, palmtops, etc.). They may be found in workstations or other devices with displays, servers, or any other type of special-purpose or general-purpose computing devices as may be desirable or appropriate for a given application or environment. Computing component 600 might also represent computing capabilities embedded within or otherwise available to a given device. For example, a computing component might be found in other electronic devices such as, for example, portable computing devices, and other electronic devices that might include some form of processing capability.

Computing component 600 might include, for example, one or more processors, controllers, control components, or other processing devices. This can include a processor, and/or any one or more of the components making up user device 102, user system 104, and non-decrypting cloud service 106. Processor 604 might be implemented using a general-purpose or special-purpose processing engine such as, for example, a microprocessor, controller, or other control logic. Processor 604 may be connected to a bus 602. However, any communication medium can be used to facilitate interaction with other components of computing component 600 or to communicate externally.

Computing component 600 might also include one or more memory components, simply referred to herein as main memory 608. For example, random access memory (RAM) or other dynamic memory, might be used for storing information and instructions to be executed by processor 604. Main memory 608 might also be used for storing temporary variables or other intermediate information during execution of instructions to be executed by processor 604. Computing component 600 might likewise include a read only memory ("ROM") or other static storage device coupled to bus 602 for storing static information and instructions for processor 604.

The computing component 600 might also include one or more various forms of information storage mechanism 610, which might include, for example, a media drive 612 and a storage unit interface 620. The media drive 612 might include a drive or other mechanism to support fixed or removable storage media 614. For example, a hard disk drive, a solid-state drive, a magnetic tape drive, an optical drive, a compact disc (CD) or digital video disc (DVD) drive (R or RW), or other removable or fixed media drive might be provided. Storage media 614 might include, for example, a hard disk, an integrated circuit assembly, magnetic tape, cartridge, optical disk, a CD or DVD. Storage media 614 may be any other fixed or removable medium that is read by, written to or accessed by media drive 612. As these examples illustrate, the storage media 614 can include a computer usable storage medium having stored therein computer software or data.

In alternative embodiments, information storage mechanism 610 might include other similar instrumentalities for allowing computer programs or other instructions or data to be loaded into computing component 600. Such instrumentalities might include, for example, a fixed or removable storage unit 622 and an interface 620. Examples of such storage units 622 and interfaces 620 can include a program cartridge and cartridge interface, a removable memory (for example, a flash memory or other removable memory component) and memory slot. Other examples may include a PCMCIA slot and card, and other fixed or removable storage units 622 and interfaces 620 that allow software and data to be transferred from storage unit 622 to computing component 600.

Computing component 600 might also include a communications interface 624. Communications interface 624 might be used to allow software and data to be transferred between computing component 600 and external devices. Examples of communications interface 624 might include a modem or softmodem, a network interface (such as Ethernet, network interface card, IEEE 802.XX or other interface). Other examples include a communications port (such as for example, a USB port, IR port, RS232 port Bluetooth® interface, or other port), or other communications interface. Software/data transferred via communications interface 624 may be carried on signals, which can be electronic, electromagnetic (which includes optical) or other signals capable of being exchanged by a given communications interface 624. These signals might be provided to communications interface 624 via a channel 628. Channel 628 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to transitory or non-transitory media. Such media may be, e.g., memory 608, storage unit 620, media 614, and channel 628. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing component 600 to perform features or functions of the present application as discussed herein.

It should be understood that the various features, aspects and functionality described in one or more of the individual embodiments are not limited in their applicability to the particular embodiment with which they are described. Instead, they can be applied, alone or in various combinations, to one or more other embodiments, whether or not such embodiments are described and whether or not such features are presented as being a part of a described embodiment. Thus, the breadth and scope of the present application should not be limited by any of the above-described exemplary embodiments.

Terms and phrases used in this document, and variations thereof, unless otherwise expressly stated, should be construed as open ended as opposed to limiting. As examples of the foregoing, the term "including" should be read as meaning "including, without limitation" or the like. The term "example" is used to provide exemplary instances of the item in discussion, not an exhaustive or limiting list thereof. The terms "a" or "an" should be read as meaning "at least one," "one or more" or the like; and adjectives such as "conventional," "traditional," "normal," "standard," "known." Terms of similar meaning should not be construed as limiting the item described to a given time period or to an item available as of a given time. Instead, they should be read to encompass conventional, traditional, normal, or standard technologies that may be available or known now or at any time in the future. Where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the aspects or functionality described or claimed as part of the component are all configured in a common package. Indeed, any or all of the various aspects of a component, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An intelligent road marker, comprising:
- a transceiver;
- a hardware processor; and
- a non-transitory machine-readable storage medium encoded with instructions executable by the hardware processor to perform a method comprising:
  - receiving a message via the transceiver, wherein the message describes a condition related to a road where the intelligent road marker is deployed, and wherein the message includes a count;
  - determining a direction in which the message is to be propagated;
  - selecting another one of a plurality of the intelligent road markers according to the determined direction, and a stored deployment pattern of the intelligent road markers; and
  - causing the transceiver to transmit the message to the selected intelligent road marker upon decrementing the count and only when the decremented count is not zero.

2. The intelligent road marker of claim 1, further comprising:
- a luminous element;
- wherein the method further comprises illuminating the luminous element based on the message.

3. The intelligent road marker of claim 2, wherein the method further comprises: illuminating the luminous element with a color and a timing according to the message.

4. The intelligent road marker of claim 1, wherein the method further comprises:
- causing the transceiver to transmit the message to a vehicle or a roadside communications station.

5. The intelligent road marker of claim 1, wherein receiving the message comprises:
- receiving the message from a vehicle or a roadside communications station.

6. The intelligent road marker of claim 1, wherein:
- each of the intelligent road markers includes a luminous element; and
- the intelligent road markers cause the luminous elements to form a determined pattern on the road in accordance with the message.

7. Non-transitory machine-readable storage medium encoded with instructions executable by a hardware processor to perform a method for an intelligent road marker, the method comprising:

receiving a message, wherein the message describes a condition related to a road where the intelligent road marker is deployed;

determining a direction in which the message is to be propagated;

selecting another one of a plurality of the intelligent road markers according to the determined direction, and a stored deployment pattern of the intelligent road markers; and transmitting the message to the selected intelligent road marker, wherein each of the plurality of intelligent road markers includes a luminous element, and wherein the luminous elements are caused to form a determined pattern on the road in accordance with the message.

8. The medium of claim 7, wherein the message includes a count, and wherein the method further comprises:

decrementing the count; and transmitting the message only when the decremented count is not zero.

9. The medium of claim 7, wherein the method further comprises:

illuminating the luminous element of the intelligent road marker based on the message.

10. The medium of claim 9, wherein the method further comprises:

illuminating the luminous element with a color and a timing according to the message.

11. The medium of claim 7, wherein the method further comprises:

transmitting the message to a vehicle or a roadside communications station.

12. The medium of claim 7, wherein receiving the message comprises:

receiving the message from a vehicle or a roadside communications station.

13. A method for an intelligent road marker, the method comprising:

receiving a message, wherein the message describes a condition related to a road where the intelligent road marker is deployed;

determining a direction in which the message is to be propagated;

selecting another one of a plurality of the intelligent road markers according to the determined direction, and a stored deployment pattern of the intelligent road markers; and transmitting the message to the selected intelligent road marker, wherein each of the plurality of intelligent road markers includes a luminous element, and wherein the luminous elements are caused to form a determined pattern on the road in accordance with the message.

14. The method of claim 13, wherein the message includes a count, and wherein the method further comprises:

decrementing the count; and transmitting the message only when the decremented count is not zero.

15. The method of claim 13, further comprising:

illuminating the luminous element of the intelligent road marker based on the message.

16. The method of claim 15, wherein the method further comprises:

illuminating the luminous element with a color and a timing according to the message.

17. The method of claim 13, further comprising:

transmitting the message to a vehicle or a roadside communications station.

* * * * *